US007401460B2

(12) United States Patent
Bloch

(10) Patent No.: US 7,401,460 B2
(45) **Date of Patent: *Jul. 22, 2008**

(54) TEXTILE THREAD HAVING A POLYTETRAFLUOROETHYLENE WRAPPED CORE

(76) Inventor: Klaus Bloch, Schwalbenweg 17, DE-53757 Sankt Augustin (DE)

( * ) Notice: Subject to any disclaimer, the term of this patent is extended or adjusted under 35 U.S.C. 154(b) by 177 days.

This patent is subject to a terminal disclaimer.

(21) Appl. No.: 10/918,334

(22) Filed: Aug. 13, 2004

(65) Prior Publication Data

US 2006/0048497 A1 Mar. 9, 2006

(51) Int. Cl.
*D02G 3/22* (2006.01)

(52) U.S. Cl. ..... 57/230; 57/235

(58) Field of Classification Search ..... 57/210–235, 57/259, 260, 31

See application file for complete search history.

(56) References Cited

U.S. PATENT DOCUMENTS

| | | | | |
|---|---|---|---|---|
| 5,288,552 | A * | 2/1994 | Hollenbaugh et al. | 428/357 |
| 5,364,699 | A * | 11/1994 | Hollenbaugh et al. | 428/357 |
| 5,494,301 | A | 2/1996 | Hamilton et al. | |
| 5,801,319 | A | 9/1998 | Hebestreit et al. | |
| 5,802,828 | A * | 9/1998 | Adorno | 57/232 |
| 6,335,093 | B1 * | 1/2002 | Mori et al. | 428/370 |
| 6,855,423 | B2 * | 2/2005 | Fidan et al. | 428/375 |
| 6,905,764 | B2 * | 6/2005 | Hornez et al. | 428/357 |
| 2002/0127398 | A1 | 9/2002 | Andrews et al. | |
| 2005/0144927 | A1 * | 7/2005 | Hornez et al. | 57/237 |
| 2005/0233143 | A1 * | 10/2005 | Tsukamoto et al. | 428/364 |
| 2006/0154065 | A1 * | 7/2006 | Bloch | 428/375 |
| 2006/0162312 | A1 * | 7/2006 | Patel et al. | 57/210 |

FOREIGN PATENT DOCUMENTS

| | | | |
|---|---|---|---|
| CH | 203114 | | 5/1939 |
| DE | 691 12 066 | T2 | 4/1996 |
| EP | 0 860 207 | A1 | 8/1998 |
| GB | 501104 | | 2/1939 |
| JP | 2003065441 | A * | 3/2003 |
| WO | 92/03922 | | 3/1992 |
| WO | 02/50351 | A1 | 6/2002 |
| WO | WO 2005001177 | A1 * | 1/2005 |

* cited by examiner

*Primary Examiner*—Shaun R Hurley
(74) *Attorney, Agent, or Firm*—Pauley Petersen & Erickson

(57) ABSTRACT

A textile thread having a core and a sheath surrounding the core. The core, formed of high-tenacity synthetic organic endless fibers, is tightly wound by slit film tapes made of polytetrafluoroethylene (PTFE) in the S-direction and the Z-direction, or vice versa, and the slit film tapes forms a sheath.

50 Claims, 3 Drawing Sheets

TEXTILE THREAD HAVING A POLYTETRAFLUOROETHYLENE WRAPPED CORE

BACKGROUND OF THE INVENTION

1. Field of the Invention

This invention relates to a textile thread with a core and a sheath surrounding the core.

2. Discussion of Related Art

Textile threads are used in very different fields of technology having various requirements. In particular, there is a demand for high-quality textile threads, which have high tensile strength along with a low elongation at tear and which are weatherproof and water-repellent and moisture-repellent, because they are exposed to greatly changing weather effects and must also absorb large dynamic stresses. Examples of these threads include fishing lines, particularly when used in salt water, or textile thread made into woven textiles, such as ground sheets or membranes for free-standing support devices in the form of sun shades, or heat-proof and fire-proof protective clothing, and the like.

Textile threads of high tensile strength are known, which are either monofilaments or multifilaments or are of pleated strings of a multitude of filaments, wherein synthetic fibers of high strength, such as aramid fibers, for example, are used. Such threads and strings have a sheath, for example by coating or extrusion, as protection against damage. It is known, for example from PCT International Publication WO 92/03922 A1, to enclose a fishing line in a PTFE layer, which increases the abrasion resistance, and which is extruded around the fiber strands and for improving the adherence between the PTFE and the fiber strand has an adhesion layer/adhesive layer. However, it is disadvantageous because for achieving the appropriately solid linkage between the sheath made of PTFE and the inside located core made of a thermoplastic material, this adhesion layer has negative effects on the sturdiness properties and is also prone to decomposition effects and dissolution effects over time.

SUMMARY OF THE INVENTION

One object of this invention is to provide a textile thread with a core and a sheath surrounding the core which meets the greatest demands on great stability, tensile strength and very little elongation at tear, which can be briefly exposed to very high service temperatures, which simultaneously has very good sliding properties, which should be UV-resistant, water-repellent, have a high abrasion resistance, and which should be visually changeable by dyeing. In many cases the threads are round and thus do not become snarled.

In one embodiment of this invention, a textile thread has a core and a sheath surrounding the core, which satisfies above-mentioned requirements and is distinguished because the core, formed from high-tenacity synthetic organically endless fibers or filaments, is tightly wound in the S-direction or Z-direction by a slit film tape of polytetrafluoroethylene (PTFE), wherein the slit film tape forms a sheath, preferably a closed sheath. Also, the first winding is in the Z-direction, and thereafter winding is performed in the S-direction. Winding is preferable alternatingly performed. The alternating winding in the S-direction and the Z-direction also includes, particularly with thicker cores, two or more slit film tapes that are first wound in the S-direction or the Z-direction, and thereafter a slit film tape is wound around the core in the opposite direction.

In accordance with one embodiment of this invention, the slit film tape is wound around the core so that a full area of one of their sides is placed against the core, or on top of one another.

In accordance with one embodiment, the slit film tapes are first twisted in a direction of their longitudinal extension, prior to being wound, for example twisted around their own axes. During this, twisting of up to 450 turns/m, preferably 250 turns/m, such as per meter of longitudinal extension the slit film tape is twisted up to 250 times completely around its longitudinal axis. Thus, twisting of the slit film tape prior to winding or wrapping it around the core, the thread of this invention has an abrasion resistance which is once more increased.

In accordance with this invention, the core made of synthetic organic endless filaments, which can be single or in bundles, and which can be made of multifilament yarns or spun yarns, provides the thread with the required tensile strength, low elongation at tear and large supporting power strength. The PTFE slit film tape as the sheath provides the required exterior properties, such a sliding properties, abrasion resistance, UV-resistance, weather-resistance, water-repellency, resistance to chemicals and/or capability of being dyed. Also, by using the slit film tape it is possible to provide a sheath which is closed like a jacket. Also, the transverse tensile strength of the core is increased by winding a tape around the core, such as a flat structure instead of filaments, which have a linear structure, because the tensile strength of the tape being the sheath contributes to the increase of the longitudinal and transverse tensile strength of the filaments of the core. Also, considerably reduced soiling is provided because of the slit film tape.

Also, the textile thread of this invention cannot only be provided with a sheath by being wound with the slit film tape, but a round cross section of the thread can also be achieved.

The structure made of only the two components, namely the material of the core and the material of the sheath, results in a considerably improved pliability and fatigue strength under reversed bending stresses in comparison, for example, with hybrid fibers containing metal wires or adhesives for stiffening the thread.

BRIEF DESCRIPTION OF THE DRAWING

Advantageous embodiments of the textile thread in accordance with this invention will become more apparent when described in view of the drawings, wherein.

DESCRIPTION OF PREFERRED EMBODIMENTS

In one preferred embodiment of this invention, the textile thread is only wound with two pieces of slit film tape made of PTFE, which form the sheath, namely a substantially closed sheath, one slit film tape is wound in the S-direction around the core, and the other slit film tape in the Z-direction, or vice versa.

The slit film tape made of PTFE is preferably wound around the core at 200 to 400 turns/m. The slit film tapes employed for producing the textile thread preferably have a width of 1 to 2 mm for the sheath. In particular, slit film tapes made of PTFE of between 220 to 880 dtex are used, a preferred range here is between 350 and 450 dtex.

Such slit film tapes made of PTFE are produced by cutting open very thin PTFE foils. Preferably the slit film tapes are made of 100% pure PTFE. PTFE can be permanently heated up to 260° C. and tolerates brief temperature peaks of the use temperature employed of up to 300° C. PTFE is non-flammable, because the limiting oxygen index (LOI) lies at 95% $O_2$. The fine tensile strength of slit film tapes made of PTFE lies in the range of 2.7 to 3.0 cN/dtex at an elongation at tear of 6% at most.

The knot strength of the textile thread in accordance with this invention is also improved by the sheath formed of slit film tape made of PTFE in comparison with, for example, sheaths made of thermoplastic materials extruded onto the thread, because the transverse tensile strength of the core is also increased by tightly wrapping the core with the slit film tape.

In accordance with this invention, high-tenacity filaments made from organic synthetic fibers with a fine tensile strength of at least 3 cN/dtex are preferably used for the textile thread of the core, wherein the elongation at tear of the filaments preferably is less than 22%.

In order to obtain a maximum strength with the least possible elongation at tear of the textile thread in accordance with this invention, the high-tenacity filaments forming the core are substantially aligned straight and parallel with each other, for example they are not twisted. Thus the textile thread with the sheath does not become snarled. Also, with a straight, non-twisted core made of filaments the original elongation at tear is maintained, for example it is not increased, because no structural elongations are added such as occur, for example, by twisting or interlacing of filaments. In case of multifilaments, the filaments are also preferably not twisted.

Figure 2:
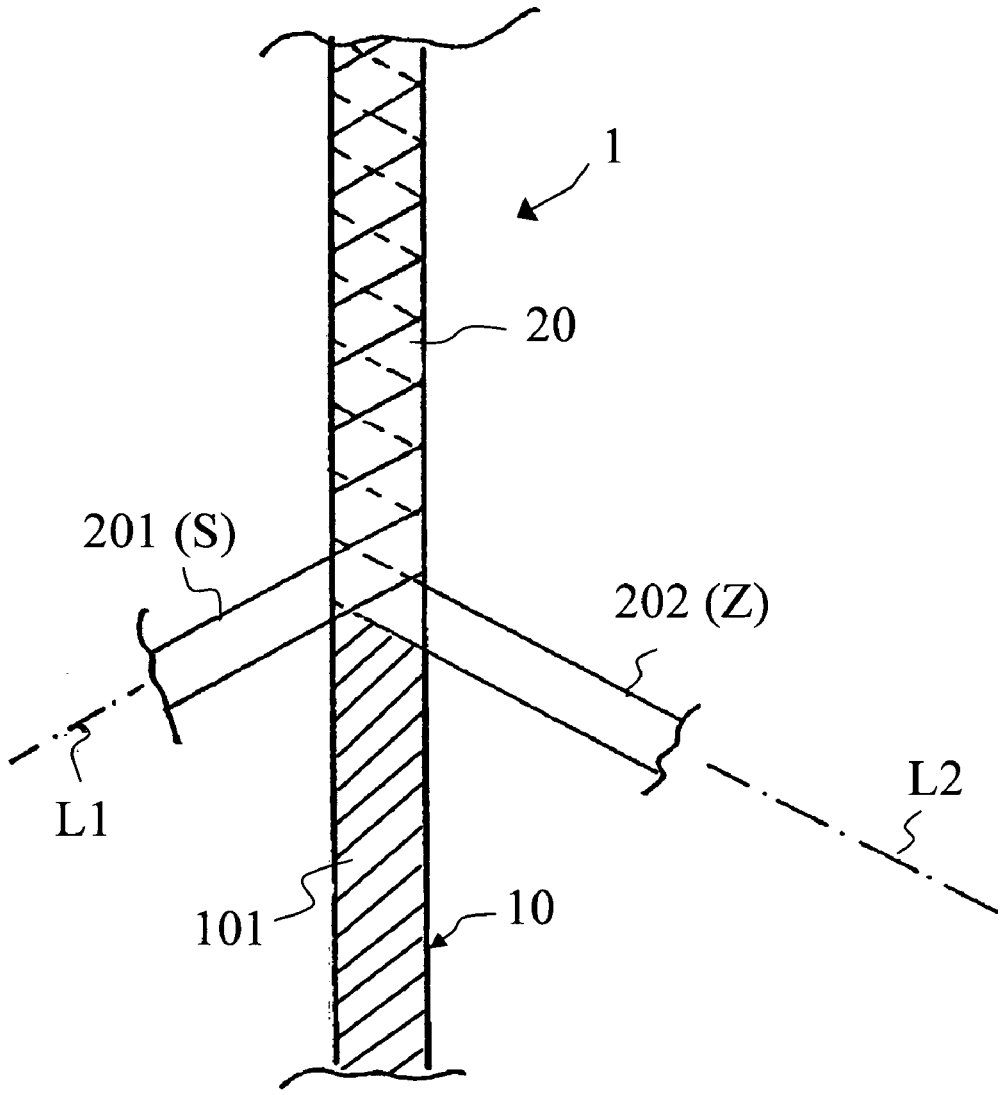
FIG. 2 is a schematic representation, not necessarily to scale, of a method for producing a textile thread of another embodiment of this invention.

It is possible to twist the filaments/filament yarns forming the core of the textile thread in accordance with this invention, such as shown in FIG. 2, slightly by 1 to 30 turns/m, in which case untwisted multifilament yarns can also be employed. Here, too, the low elongation at tear is substantially preserved. If, however, textile threads of high strength are desired, wherein the elongation at tear is allowed to be greater, it is possible to employ a core in which the filaments/filament yarns are twisted with more than 30 turns/m, for example in the range of 50 to 500 turns/m.

However, for the embodiment of the thread in accordance with this invention, the core and the sheath are mechanically combined to form a unit by solidly winding the slit film tape made of PTFE around them, without any adhesive layer, such as fusion adhesives or other binders, and also without coupling agents. A very pliant thread is thus obtained.

Figure 3:
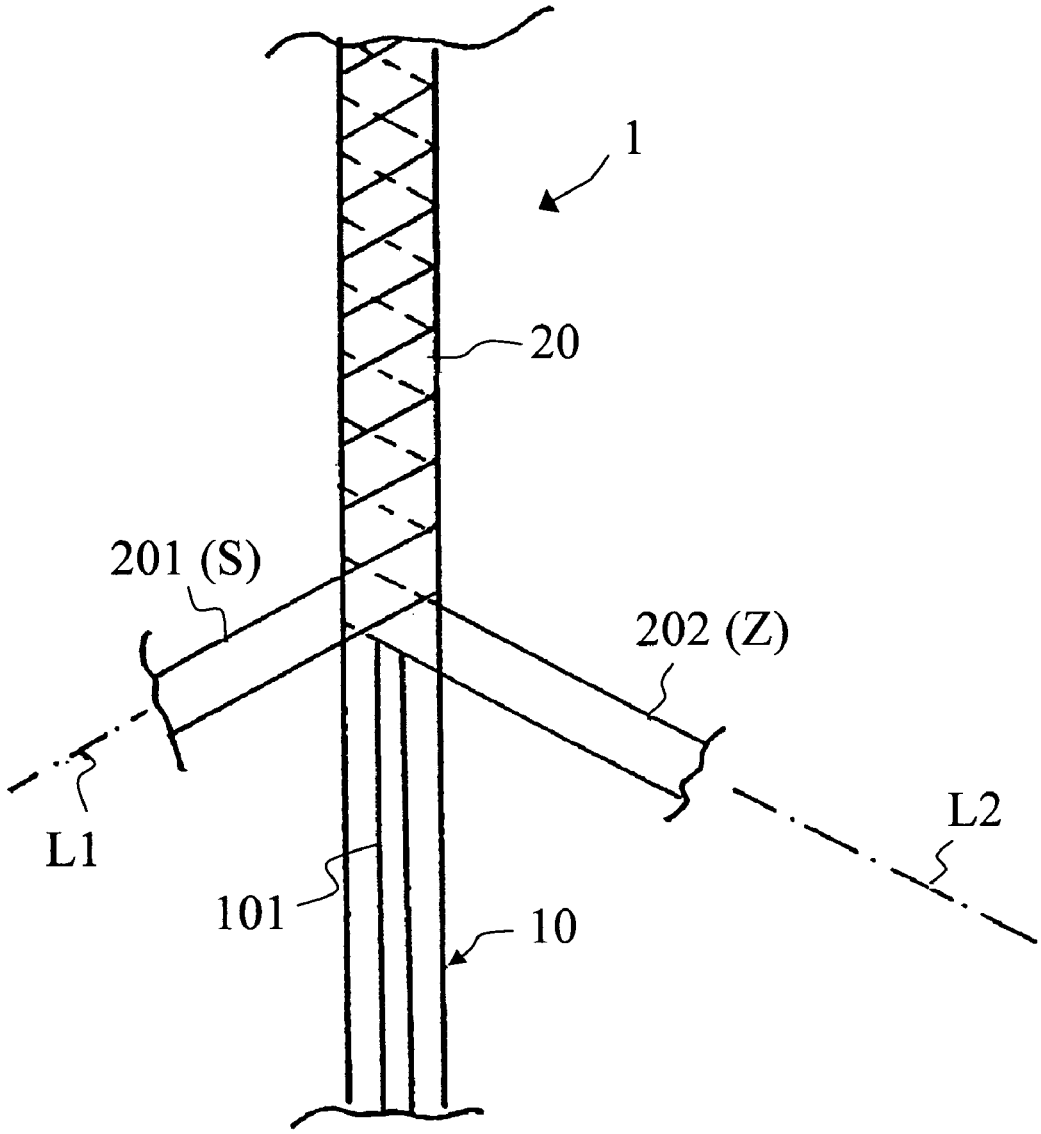
FIG. 3 is a schematic representation of a method for producing a textile thread of yet another embodiment of this invention.

It is sufficient for the use of many textile threads for the core to be formed by filaments/filament yarns which are the same. On the other hand, textile threads are also demanded which, besides great strength and temperature resistance, should have additional properties, for example conductivity. For these cases, the textile thread has a core formed from filaments of different structure of the material/stock and or shape, such as shown in FIG. 3, in accordance with the stated requirements.

Filaments in the form of multifilaments are preferably used for the core. Multifilaments are formed of individual filaments of a fineness of less than 10 μm wherein, for example, a multifilament yarns of 550 dtex includes approximately 85 to 90 filaments of a fineness of 6 μm. Spun glass can also be used for a straight untwisted core of filaments. Multifilament yarns of 40 to 1,800 dtex are preferably used, while for special designs even finer multifilament yarns/multifilaments can be employed. The preferred customary range, however, lies with multifilament yarns of 160 to 1,100 dtex. Multifilament yarns, whose filaments are not twisted together, are customarily used.

In accordance with one preferred embodiment of the textile thread of this invention, high-tenacity filaments made of polyethylene of an ultra-high molecular weight (UHMW-PE) of 110 to 1,760 dtex and a fine tensile strength of at least 20 cN/dtex, preferably at least 25 cN/dtex and an elongation at tear of less than 8%, preferably less than 5%, are used for the core. The core provides the textile thread with a large supporting power, along with very little elongation at tear, such as is desired, for example, when using the textile thread directly as a string or a fishing line.

In accordance with a further embodiment of the textile thread of this invention, high-tenacity filaments of a great thermal stability made of polyesters of terephthalic acid, such as polyterephthalates, with an elongation at tear of less than 22%, preferably of approximately 8 to 20%, and a fine tensile strength of at least 4 cN/dtex and a short-term use temperature of up to 180° C. are used for the core. This textile thread is also distinguished by a large supporting power and load-bearing capacity and weather resistance. In accordance with a further embodiment of the textile thread of this invention, high-tenacity filaments for the core are selected, for example, from high-tenacity synthetic fibers of polyamides, in particular polyamide 6, polyamide 610 and polyamide MXD6, with a tear at elongation of less than or equal to 20%, a fine tensile strength of at least 4 cN/dtex and a short-time use temperature of up to 180° C. or more.

Another preferred embodiment of a textile thread in accordance with this invention has a core of high-tenacity, highly temperature-resistant and greatly non-flammable synthetic fibers of fully aromatic polyamides (aramides), such as, poly-p-phenylene terephthalamide or poly-m-phenyleneisophthalamide with elongations at tear of less than 22%, preferably in the range of approximately 2 to 6%, a fine tensile strength of at least 15 cN/dtex and a short-time use temperature of up to 300° C. It is possible to produce textiles made of textile threads with a core on the basis of aramides and sheaths of slit film tape made of PTFE in accordance with this invention, which are used as heat shields, for example protective suits or membranes for free-standing support devices which are subjected to intense solar radiation and which meet the requirements of difficult to ignite. The sheath of PTFE tapes furthermore assures UV-resistance, abrasion resistance and high sliding properties, along with soiling-resistance and water-repellency, and reversed bending stress resistance.

For special technical textile threads, and flat textile structures to be produced therefrom, high-tenacity and highly temperature-resistant synthetic fibers made from fully aromatic polyesters, such as polyacrylates, from aromatic polysulfides and -sulfones, such as polyaryl sulfones, polyphenylene sulfides, polyaryl ether ketones, aromatic polyimides, such as polyimide, poly(benzimidazole), polyamide imide, polyether imide, polyester imide, polyaryl imide, with a short-term use temperature of at least 200° C. and up to 300° C. or more can be used for the core. Textile threads in accordance with this invention should be made difficult to ignite, or non-flammable, for example to employ filaments on the basis of fluorocarbon polymers for the core, such as fluorocarbon homopolymers like poly(tetrafluoroethylene) and poly(chlorotrifluoroethylene), or from the fluorine copolymers such as ethylene tetrafluoroethylene copolymer or polyfluoroethylene propylene. The listing of synthetic fibers which can be used for making the core of the textile thread in accordance with this invention is not conclusive but, instead it is given by way of example. Suitable mixtures of the above-mentioned plastics can also be used as filaments.

Depending on the circumference of the core, the textile threads in accordance with this invention can have a diameter of 0.12 to 1.5 mm. The textile thread in accordance with this invention with the core and sheath of slit film tape made of PTFE has the shape of a monofilament on the exterior, namely a smooth surface, and little elongation at tear, along with high strength and supporting power, as well as a round cross section.

In connection with selected areas of application of the textile thread in accordance with this invention, it is desirable that preferred properties are improved, in particular in connection with filaments made of a different material which form the core. In accordance with this invention, with the textile thread the core contains at least one conductive filament or filament yarn in addition to the thermoplastic materials. In this case conductive filaments are preferred which have a resistance of $10^0$ to $10^{10}$ Ohm/cm. The conductive filaments preferably contain nylon or polyester as the thermoplastic material. The conductivity is achieved by the addition of carbon which can be contained in the filament and/or is applied by vacuum evaporation. A content of 5 weight-% of carbon is sufficient. The conductive filament yarns are preferably used in a fine embodiment, preferably in the range of 18 to 40 dtex. In this case a conductive filament yarn can have between 1 to 10 filaments. Nylon with a melting point in the range of approximately 215° C., or polyester with a melting point in the range of approximately 255° C. are preferred for the conductive filaments. The conductive filament/filament yarn lends the textile thread improved knot strength and improves the transverse tensile strength, and it also contributes to the improvement of the adhesion of the sheath to the filaments of the core. However, the core is preponderantly of filaments of high-strength synthetic fibers and only of a small proportion of conductive filaments, preferably in the range between 3 to 12 weight-%.

For use as fishing lines, textile threads in accordance with this invention are preferably used, which have a core of ultra-high molecular weight of 110 to 1,760 dtex and a fine tensile strength of at least 20 cN/dtex and an elongation at tear of less than 8%, preferably less than 4%, as well as with 3 to 12 weight-% of conductive filament yarn on the basis of nylon or polyester in relation to the total weight, as previously explained, wherein the sheath has two slit film tapes made of PTFE, which are wound around the core in the S-direction and the Z-direction at 200 to 400 turns/m, wherein the slit film tapes preferably have a width of 1 to 1.5 mm. The core of multifilament yarns of UHMW-PE of preferably 165 to 880 dtex and conductive filament yarns remains without twisting and smooth, or only lightly twisted at less than 30 turns/m. By being wound around with slit film tape, a tight interconnection of the textile thread is achieved without any fusion adhesives or other binders, wherein a closed sheath is formed. The water-repellent embodiment of the sheath and its closed form also prevent seawater from penetrating the thread when used as fishing line, which would leave behind salt crystals after drying, which would result in friction every time the fishing line is unwound and in the destruction of the fishing line.

When using multifilament yarns made of UHMW-PE of 220 dtex (200 dernier) with a tensile strength of 31 cN/dtex and a strength of 35 g/den, a thread of 0.19 mm diameter has a supporting power of approximately 8.1 kg, which is made of 5.2 kg from the portion of the core and 2.9 kg of the sheath made of the slit film tape made of PTFE.

With a textile thread of a diameter of 0.35 mm with multifilaments made of UHMW-PE of the core of 880 dtex (800 dernier), a supporting strength of approximately 30 kg results, which is made of 28 kg based on the core and further 2.5 to 3 kg as the contribution of the sheath of slit film tape made of PTFE.

Because the specific weight of the slit film tape made of PTFE is considerably higher than that of water, the specific weight of the multifilament of the core of UHMW-PE is slightly less than that of water, it is possible to determine the weight of the textile thread/fishing line by the portion and proportion of the weight of the core and the weight of the sheath, so that it is slightly heavier than water and thus does not float on the water, but rather sinks. A specific weight of the textile thread for use as a fishing line in the range of approximately 1.5 to 1.8 g/cm$^3$ is preferred. A heavy textile thread has the advantage that it can be cast more easily, because it develops a greater kinetic energy.

Textile threads in accordance with this invention, which have a core of high-tenacity, highly temperature-resistant and difficult to ignite synthetic fibers, for example of aramides, and which are enclosed in a sheath of slit film tapes made of PTFE, are particularly suitable for the production of flat textile structures for use as heat protection, for example for making protective clothing which can briefly be exposed to temperatures above 300° C., so that hot metal particles of, for example, 500° C. also flake off. Flat textile structures of this type also have a very low elongation at tear and thus are also suitable as membranes for free-standing support devices for heat protection, for example tent roofs and the like under high stress, also high mechanical stresses. Because of the chemical resistance of the sheath, the flame resistance/heat resistance of the textile threads and textiles/wovens made thus is also maintained after many washings and cleanings.

The water absorption of the textile threads of this invention is extraordinarily low and negligible, because the sheath of PTFE tapes is water-repellent.

Figure 1:
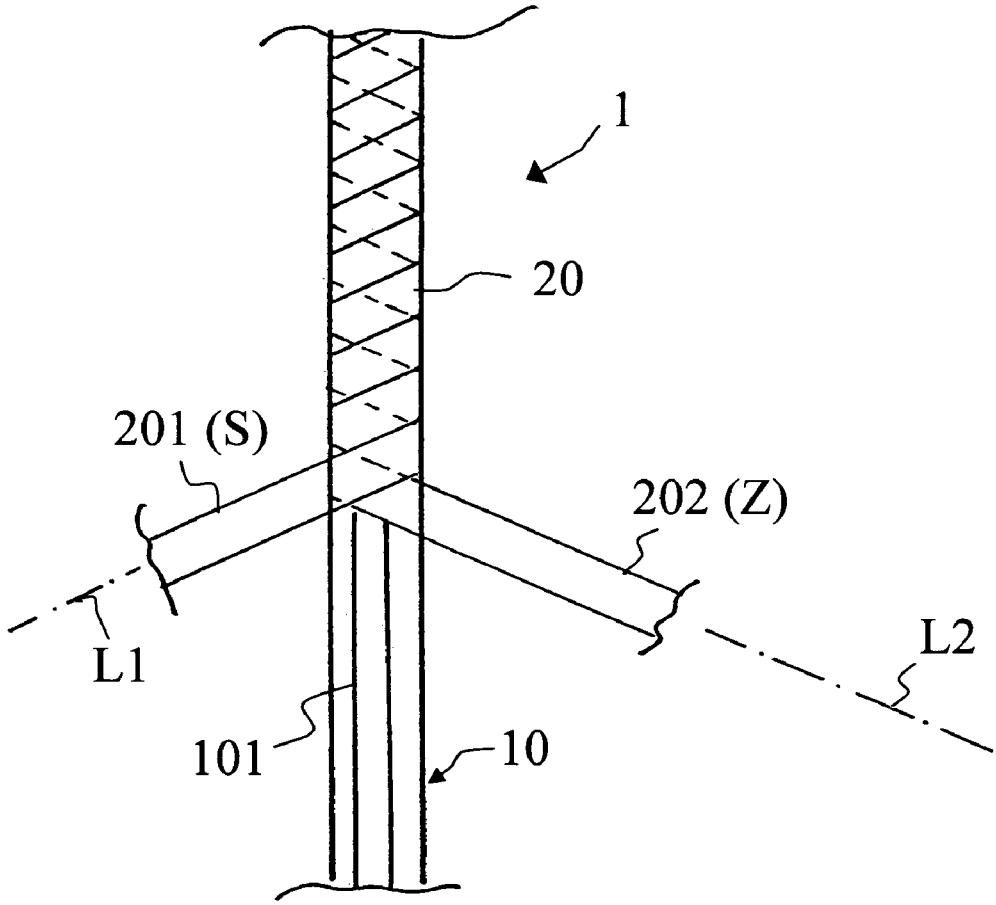
FIG. 1 is a schematic representation of a method for producing a textile thread of this invention, with its individual components.

In FIG. 1, the individual components of the textile thread in accordance with this invention are schematically represented during production. The textile thread 1 comprises a core 10 made of filaments 101, or filament yarns 101 which, in the example shown, are arranged without twisting and extending parallel with each other. Two slit film tapes 201, 202 made of PTFE are wound around the core 10, wherein the slit film tape 202 is wound around the core 10 in the Z-direction and the slit film tape 201 is wound around the core 10 in the S-direction, or vice versa, so that the two slit film tapes form a closed sheath 20 made of PTFE. The film tapes 201, 202 are tightly wound around the core 10 with 200 to 400 turns/m, for example, wherein they are wound while resting entirely flat with one side on the core, or on the first slit film tape already resting on the core. The transverse tensile strength of the thread 1, and thus also its knot strength, are also improved by this winding of the slit film tapes 201, 202 around the core 10. The core 10 and the sheath 20 form a tight interconnection without any adhesives or other aids.

Prior to winding them around the core 10, it is also possible to twist the slit film tapes in the direction of their longitudinal axes L1 or L2 by up to 450 turns/m, preferably up to 250 turns/m, in order to obtain still greater abrasion resistance of the textile thread.

What is claimed is:

1. A textile thread having a core and a sheath surrounding the core, the textile thread comprising: the core, formed of high-tenacity synthetic organic endless fibers, a plurality of slit film tapes made of polytetrafluoroethylene (PTFE) tightly wound about the core in a S-direction and a Z-direction, and the slit film tapes forming a sheath, wherein the slit film tapes are twisted around a longitudinal axis and are wound around the core in a twisted state.

2. The textile thread in accordance with claim 1, wherein the slit film tapes contact against a full surface of one of a side of the core and each other.

3. The textile thread in accordance with claim 1, wherein the slit film tapes are twisted at up to 450 turns/m, around the longitudinal axis.

4. The textile thread in accordance with claim 3, wherein the sheath is formed by two slit film tapes made of PTFE, one wound in the S-direction around the core and another wound in the Z-direction around the core.

5. The textile thread in accordance with claim 4, wherein the slit film tapes are wound around the core at 200 to 400 turns/m.

6. The textile thread in accordance with claim 5, wherein the slit film tapes having a width of 1 mm to 2 mm are used for the sheath.

7. The textile thread in accordance with claim 6, wherein the slit film tapes are of 220 dtex to 880 dtex.

8. The textile thread in accordance with claim 7, wherein the slit film tapes are of 350 dtex to 450 dtex.

9. The textile thread in accordance with claim 8, wherein the core is of high-strength filaments of a fine tensile strength of at least 3 cN/dtex.

10. The textile thread in accordance with claim 9, wherein the core is of high-strength filaments of an elongation at tear of less than 22%.

11. The textile thread in accordance with claim 10, wherein the high-tenacity filaments forming the core are aligned extending substantially straight and parallel with each other.

12. The textile thread in accordance with claim 10, wherein high-tenacity filaments forming the core are twisted together with each other by 1 turn/m to 30 turns/m.

13. The textile thread in accordance with claim 10, wherein the high-tenacity filaments forming the core are twisted together with each other by more than 30 turns/m.

14. The textile thread in accordance with claim 13, wherein the core is formed of filaments that are identical to each other.

15. The textile thread in accordance with claim 13, wherein the core is formed of filaments of different structures with respect to at least one of a material and a shape.

16. The textile thread in accordance with claim 15, wherein multifilament yarns of 40 dtex to 1,800 dtex are used for the core.

17. The textile thread in accordance with claim 16, wherein high-tenacity filaments made of polyethylene with an ultra-high molecular weight (UHMW-PE) of 110 dtex to 1,760 dtex and a fine tensile strength of at least 20 cN/dtex and an elongation at tear of less than 8% are used for the core.

18. The textile thread in accordance with claim 16, wherein high-tenacity filaments having a high thermal stability made from polyesters of a terephthalic acid of a fine tensile strength of at least 4 cN/dtex and an elongation at tear of less than 22% and a short-term use temperature of up to 180° C. are used for the core.

19. The textile thread in accordance with claim 16, wherein high-tenacity filaments made of polyamides of an elongation at tear of less than 22% and a fine tensile strength of at least 4 cN/dtex and a short-term use temperature of up to 180° C. are used for the core.

20. The textile thread in accordance with claim 16, wherein high-tenacity filaments of a high temperature resistance and which are difficult to ignite, made of fully aromatic polyamides (aramides) including one of poly-p-phenylene terephthalamide and poly-m-phenyleneisophthalamide with elongations at tear of less than 20%, a fine tensile strength of at least 15 cN/dtex and a short-time use temperature of up to 300° C. are used for the core.

21. The textile thread in accordance with claim 16, wherein high-tenacity and highly temperature-resistant synthetic fibers of high thermal stability made from fully aromatic polyesters, such as polyacrylates, from aromatic polysulfides and -sulfones, such as polyaryl sulfones, polyphenylene sulfides, polyaryl ether ketones, aromatic polyimides, such as polyimide, poly(benzimidazole), polyanilde imide, polyether imide, polyester imide, polyaryl imide, with a short-term use temperature of at least 200° C. are used for the core.

22. The textile thread in accordance with claim 16, wherein high-tenacity filaments of high thermal stability and which are difficult to ignite on the basis of fluorocarbon polymers, such as fluorocarbon homopolymers like poly(tetrafluoroethylene), poly(chlorotrifluoroethylene), and from fluorine copolymers such as ethylene tetrafluoroethylene copolymer, polyfluoroethylene propylene are used for the core.

23. The textile thread in accordance with claim 14, wherein the core contains at least one of a conductive filament and a multifilament yarn and the filaments made of thermoplastic materials.

24. The textile thread in accordance with claim 23, wherein the at least one of the conductive filament and the multifilament yarn has an electrical resistance of $10^{0}$ Ohm/cm to $10^{10}$Ohm/cm.

25. The textile thread in accordance with claim 24, wherein the at least one of the conductive filament and the multifilament yarn one of contains carbon and has carbon applied by vacuum evaporation.

26. The textile thread in accordance with claim 25, wherein the core contains 3 to 12 weight-% of the at least one of the conductive filament and the multifilament yarn.

27. The textile thread in accordance with claim 26, wherein the at least one of the conductive filament and the multifilament yarn contains one of nylon and polyester as the thermoplastic material.

28. The textile thread in accordance with claim 26, wherein the conductive filament is of a yarn of 18 dtex to 40 dtex.

29. The textile thread in accordance with claim 1, wherein the sheath is formed by two slit film tapes made of PTFE, one wound in the S-direction around the core and another wound in the Z-direction around the core.

30. The textile thread in accordance with claim 1, wherein the slit film tapes are wound around the core at 200 to 400 turns/m.

31. The textile thread in accordance with claim 1, wherein the slit film tapes having a width of 1 mm to 2 mm are used for the sheath.

32. The textile thread in accordance with claim 1, wherein the slit film tapes are of 220 dtex to 880 dtex.

33. The textile thread in accordance with claim 1, wherein the core is of high-strength filaments of a fine tensile strength of at least 3 cN/dtex.

34. The textile thread in accordance with claim 1, wherein the core is of high-strength filaments of an elongation at tear of less than 22%.

35. The textile thread in accordance with claim 1, wherein the high-tenacity filaments forming the core are aligned extending substantially straight and parallel with each other.

36. The textile thread in accordance with claim 1, wherein high-tenacity filaments forming the core are twisted together with each other by 1 turn/m to 30 turns/m.

37. The textile thread in accordance with claim 1, wherein the high-tenacity filaments forming the core are twisted together with each other by more than 30 turns/m.

38. The textile thread in accordance with claim 1, wherein the core is formed of filaments that are identical to each other.

39. The textile thread in accordance with claim 1, wherein the core is formed of filaments of different structures with respect to at least one of a material and a shape.

40. The textile thread in accordance with claim 1, wherein multifilament yarns of 40 dtex to 1,800 dtex are used for the core.

41. A textile thread having a core and a sheath surrounding the core, the textile thread comprising: the core, formed of high-tenacity synthetic organic endless fibers, a plurality of slit film tapes made of polytetrafluoroethylene (PTFE) tightly wound about the core in a S-direction and a Z-direction, and the slit film tapes forming a sheath, wherein high-tenacity filaments made of polyethylene with an ultra-high molecular weight (UHMW-PE) of 110 dtex to 1,760 dtex and a fine tensile strength of at least 20 cN/dtex and an elongation at tear of less than 8% are used for the core.

42. The textile thread in accordance with claim 1, wherein high-tenacity filaments having a high thermal stability made from polyesters of a terephthalic acid of a fine tensile strength of at least 4 cN/dtex and an elongation at tear of less than 22% and a short-term use temperature of up to 180° C. are used for the core.

43. The textile thread in accordance with claim 1, wherein high-tenacity filaments made of polyamides of an elongation at tear of less than 22% and a fine tensile strength of at least 4 cN/dtex and a short-term use temperature of up to 180° C. are used for the core.

44. The textile thread in accordance with claim 1, wherein high-tenacity filaments of a high temperature resistance and which are difficult to ignite, made of fully aromatic polyamides (aramides) including one of poly-p-phenylene terephthalamide and poly-m-phenyleneisophthalamide with elongations at tear of less than 20%, a fine tensile strength of at least 15 cN/dtex and a short-time use temperature of up to 300° C. are used for the core.

45. The textile thread in accordance with claim 1, wherein high-tenacity and highly temperature-resistant synthetic fibers of high thermal stability made from fully aromatic polyesters, such as polyacrylates, from aromatic polysulfides and -sulfones, such as polyaryl sulfones, polyphenylene sulfides, polyaryl ether ketones, aromatic polyimides, such as polyimide, poly(benzimidazole), polyamide imide, polyether imide, polyester imide, polyaryl imide, with a short-term use temperature of at least 200° C. are used for the core.

46. The textile thread in accordance with claim 1, wherein high-tenacity filaments of high thermal stability and which are difficult to ignite on the basis of fluorocarbon polymers, such as fluorocarbon homopolymers like poly(tetrafluoroethylene), poly(chlorotrifluoroethylene), and from fluorine copolymers such as ethylene tetrafluoroethylene copolymer, polyfluoroethylene propylene are used for the core.

47. The textile thread in accordance with claim 1, wherein the textile thread is used as a fishing line.

48. The textile thread in accordance with claim 1 wherein the textile thread is used in a woven textile.

49. A textile thread, comprising:

a core, the core formed of high-tenacity synthetic organic endless fibers that are identical to each other and made of polyethylene with an ultra-high molecular weight (UHMW-PE); and a sheath surrounding the core, the sheath including a plurality of slit film tapes made of polytetrafluoroethylene (PTFE), each of the slit film tapes tightly wound around the core in a S-direction and a Z-direction.

50. The textile thread in accordance with claim 49, wherein the high-tenacity synthetic organic endless fibers are twisted together with each other by 1 turn/m to 30 turns/m.

* * * * *